United States Patent [19]

Sauls

[11] 4,411,605

[45] Oct. 25, 1983

[54] INVOLUTE AND LAMINATED TIP SEAL OF LABYRINTH TYPE FOR USE IN A SCROLL MACHINE

[75] Inventor: John R. Sauls, La Crosse, Wis.

[73] Assignee: The Trane Company, La Crosse, Wis.

[21] Appl. No.: 316,261

[22] Filed: Oct. 29, 1981

[51] Int. Cl.[3] ..... F01C 1/02; F01C 19/08; F16J 15/16

[52] U.S. Cl. ..... 418/55; 418/141; 418/142; 277/57; 277/133; 277/204

[58] Field of Search ..... 418/55, 141, 142; 277/53, 57, 133, 134, 163, 204

[56] References Cited

U.S. PATENT DOCUMENTS

| | | | |
|---|---|---|---|
| 801,182 | 10/1905 | Creux | 418/55 |
| 3,185,386 | 5/1965 | Peras | 418/142 |
| 3,392,910 | 7/1968 | Tanzberger | 277/53 |
| 3,924,977 | 12/1975 | McCullough | 418/55 |
| 3,994,636 | 11/1976 | McCullough et al. | 418/55 |

FOREIGN PATENT DOCUMENTS

| | | | |
|---|---|---|---|
| 55-37515 | 3/1980 | Japan | 418/55 |
| 55-37516 | 3/1980 | Japan | 418/55 |
| 55-40261 | 3/1980 | Japan | 418/55 |

*Primary Examiner*—John J. Vrablik

*Attorney, Agent, or Firm*—Carl M. Lewis; Ronald M. Anderson; Raymond W. Campbell

[57] ABSTRACT

An involute and tip seal for use in a positive fluid displacement apparatus of the scroll type. A scroll machine wrap element of general spiral configuration about an axis includes a radially inner and outer flank surface terminating in a tip. In the tip, a groove is formed which runs in the longitudinal direction of the wrap element and substantially conforms to its spiral shape. A plurality of material strips, generally coaligned in parallel side-by-side relationship, are disposed within the spiral groove of the involute wrap. One or more of the strips includes a plurality of notches along at least one of the two axial edges. These notches, in conjunction with one or more of the adjacent strips and a flat surface against which the notched edge abuts, define a plurality of labyrinth pockets longitudinally spaced along the strips. The labyrinth surface improves both longitudinal and transverse fluid sealing of the involute tip seal.

27 Claims, 8 Drawing Figures

INVOLUTE AND LAMINATED TIP SEAL OF LABYRINTH TYPE FOR USE IN A SCROLL MACHINE

DESCRIPTION

1. Technical Field

This invention generally pertains to positive displacement machines of the scroll type, and specifically, to the involute and tip seals used therein.

2. Background Art

Scroll type positive fluid displacement apparatus typically include parallel plates having involute wrap elements attached in intermeshed, fixed angular relationship. The axes of the wrap elements are normally parallel and offset such that their relative orbital motion causes pockets of fluid defined by flank surfaces of the wrap elements and the end plates, to move between an inlet port and an outlet port.

Depending upon the configuration of the involute wrap elements and the relative direction of their orbital motion, a scroll machine may function as an expander (vacuum pump), a compressor, or a liquid pump. When used as an expander, the pockets of fluid moving through the machine originate near the center of the involutes and expand in volume as they move outward around the wraps. Conversely, in a scroll compressor, pockets of fluid move inward and around the scroll wraps to a center discharge port, experiencing a substantial reduction of their volume in the process. In a liquid pump, each of the involute wraps makes only a single loop about the central axis such that the pockets of liquid are not subjected to a significant change in volume as they are moved inward around the scroll toward a central discharge port.

The operating effiency of a scroll machine is particularly dependent upon the effectiveness of the seal between the flank surfaces of the involute wraps in the radial direction, and between the tip of the wraps and the facing end plate in the axial direction. For applications where effective radial sealing is less important, a small clearance may be maintained between the flank surfaces of the intermeshed scrolls such that they do not contact each other. This design has been referred to as a "fixed-crank" type scroll machine, an example of which is disclosed in U.S. Pat. No. 4,082,484. In a more common approach generally providing higher operating efficiency, the flank surfaces of the intermeshed wrap elements are caused to contact each other with the desired moving line radial sealing force. A scroll machine so configured is thus conveniently referred to as a "radially complaint" type. U.S. Pat. No. 3,924,977 discloses radially complaint linking means for linking a driving mechanism to an orbiting scroll member.

Tip seals have long been used in scroll machines, as evidenced by their description in U.S. Pat. No. 801,182. Typically in the prior art, a single strip of material of either metallic or non-metallic nature is applied in a groove formed in the involute wrap element tip surface. Another U.S. patent application, Ser. No. 232,526, filed on Feb. 9, 1981 and assigned to the same assignee as the subject application, discloses the use of strips of material arranged side-by-side at least partially in an involute tip groove, to form a laminated tip seal. As that application points out, a tip seal comprising a single strip of material must be machined or otherwise formed to the precise involute shape of the groove in the wrap element, unless the material is sufficiently elastic to conform to the scroll groove shape without breakage. In comparison, a tip seal comprising a plurality of laminated strips has the advantage that each strip is thin and therefore relatively flexible, so that the composite laminated strip seal is easily able to conform to the spiral shape of the groove in the wrap element.

Regardless of the type of seal used, it is important to minimize fluid leakage to achieve high efficiency. Fluid leakage past the tips of the scroll wrap element may be reduced by providing a notched surface on the tip where it contacts the facing scroll plate. It is known in the prior art that any notched or labyrinth surface juxtapositioned in sealing relationship to a facing surface is effective to trap fluid as it flows from pocket to pocket in the labyrinth, substantially showing its leakage between the surfaces. However, it is apparent that it would be difficult and expensive to machine or form a labyrinth on either the tip of the involute wrap element directly, or on the outer surface of a single strip tip seal.

In consideration of the above, it is therefore an object of this invention to provide an improved involute and tip seal having the benefits of the laminated strip construction and the labyrinth pattern of notches to reduce both transverse and longitudinal fluid leakage.

It is a further object of this invention to provide a labyrinth type tip seal which is relatively easy to machine and low in cost.

It is still a further object of this invention to reduce fluid leakage in both the transverse and longitudinal directions along the bottom of the groove in the wrap element, within which the tip seal is seated.

These and other objects of the subject invention will become apparent from the description of the preferred embodiments contained hereinbelow and by reference to the attached drawings.

DISCLOSURE OF THE INVENTION

For use in a positive fluid displacement machine of the scroll type, an involute and tip seal are provided which comprise a wrap element of generally spiral configuration about an axis. The spiral wrap element includes both radially inner and outer flank surfaces which terminate in a tip. A groove is formed in the tip of the wrap element and runs along it in the longitudinal direction, substantially conforming to its spiral shape. Disposed within the spiral groove are a plurality of material strips, generally coaligned in parallel side-by-side relationship. One or more of the strips include a plurality of notches along at least one edge, which in conjunction with one or more of the other of the strips and a flat surface which the edge abuts define a plurality of labyrinth pockets longitudinally spaced along the strips.

In one embodiment, the notches are rectangular in shape, being longer in length, measured longitudinally along the strip, than in depth, measured across the width of the strip. In another embodiment, the notches are generally of an angled "V" shape, with one side of the "V" relatively longer than the other side, the open part of the "V" being along the edge of the strip. The notches may be provided along only one or along both edges of the laminated strips, so that improved sealing is obtained either between the bottom of the groove and the tip seal, or between the tip seal and the adjacent scroll surface, or both.

DESCRIPTION OF THE PREFERRED EMBODIMENTS

Figure 1:
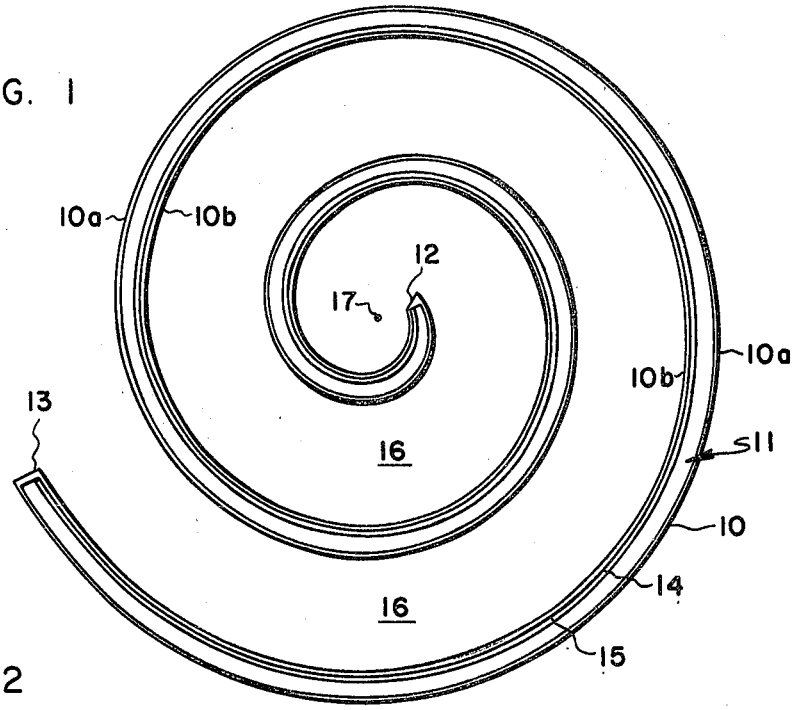
FIG. 1 is a plan view of an involute wrap element for use in a scroll machine, showing in general, the subject tip seal seated within the groove formed in the wrap element.

With reference to FIG. 1, an involute 10 for use in positive fluid displacement apparatus of the scroll type includes a radially outer flank surface 10*a* and a radially inner flank surface 10*b*, which are of generally spiral configuration about an axis designated by reference numeral 17. Flank surfaces 10*a* and 10*b* extend in an axial direction, running longitudinally from an end 12, where a relatively high pressure compressed fluid is discharged, to an end 13, where fluid is drawn into the involute for compression, at suction pressure. Involute 10 includes a groove 14 on its tip surface, between flank surfaces 10*a* and 10*b*. A tip seal 11 is seated within groove 14, with a gap 15 provided between the radially inner surface of groove 14 and the adjacent side of tip seal 11. Only the general configuration of tip seal 11 is shown in FIG. 1, the details thereof being disclosed in FIGS. 2–7.

As illustrated in the drawings, wrap element 10 is attached to an end plate 16 (the periphery of which is not shown). As is well known in the art, two such end plates 16 with attached involutes 10 may be used to compress, expand, or pump a fluid. The preferred embodiment of the subject invention disclosed herein is directed toward the application of the involute 10 and tip seal 11 for use in a compressor, however, these elements are equally applicable to other scroll machine configurations.

Figure 2:
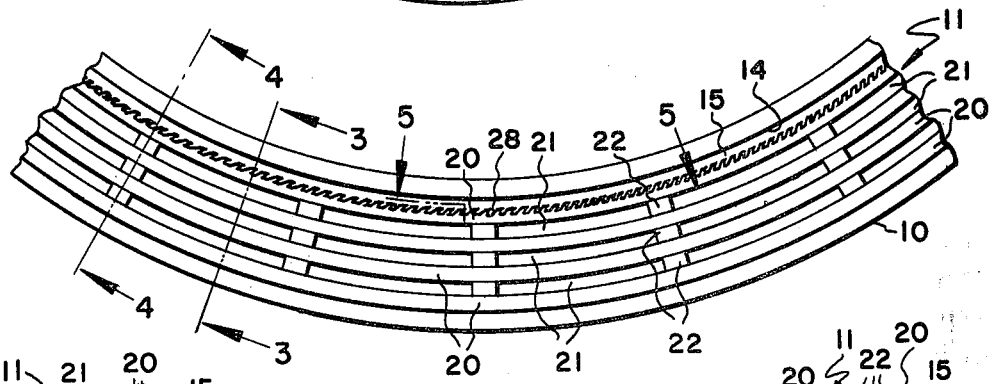
FIG. 2 is an exploded plan view of the exposed edge of one embodiment of the laminated tip seal, wherein the labyrinth notches are transversely aligned.
Figure 3:
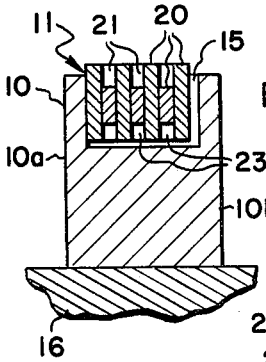
FIG. 3 is a cross-sectional view of the tip seal and involute taken along section line 3—3 of FIG. 2.

Turning now to FIG. 2, a more detailed view of the subject invention shows that the tip seal 11 comprises a plurality of material strips 20 generally thinner in the radial direction as compared to their width in the axial direction. These strips 20 extend longitudinally from one end 12 of involute 10 to the end 13 thereof. In the preferred embodiments shown in FIGS. 3, 4, and 5, alternate ones of the strips 20 include rectangular-shaped notches 21 along their outwardly facing edges, said notches 21 being separated from each other by teeth 22. In addition, the same strips 21 which are notched along their outer edge, include "V"-shaped notches 23 along their edge adjacent the bottom of groove 14. "V"-shaped notches 23 are separated from each other in the longitudinal direction of the strips 21 by teeth 24 which are slanted at an angle toward the higher fluid pressure end 12 of involute 10. Because of the slope of teeth 24, "V"-shaped notches 23 have one side relatively longer than the other. It will be apparent, that the longer side of the "V"-shaped notch 23 is longitudinally closer to the relatively high pressure end 12 than it is to the lower pressure end 13. This configuration produces a more effective fluid seal than a "V" notch having equal length sides. The dimensional characteristics of the "V"-shaped notches 23 are referenced in FIG. 5A. In the preferred embodiment, these dimensions have the following characteristics: $b/h<1.0$; $D/p=1.0$; Angle $A=40°$; and $D/h>5.0$.

Figure 4:
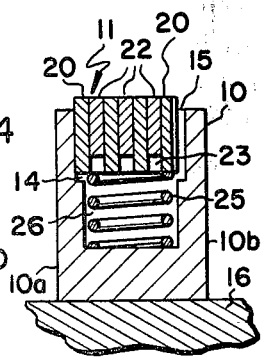
FIG. 4 shows an embodiment of the subject tip seal and involute taken along section line 4—4 of FIG. 2, wherein a spring biasing means is used to apply an axial sealing force to the tip seal.
Figure 5:
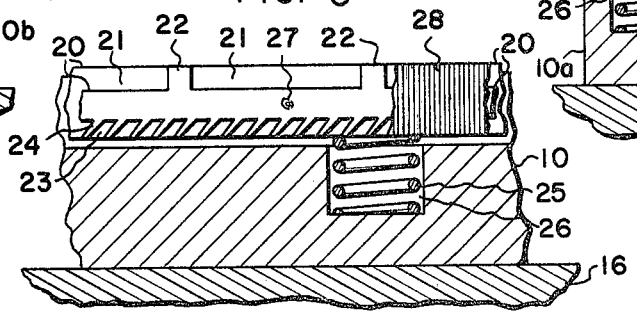
FIG. 5 is a cross-sectional view taken along section line 5—5 of FIG. 2 showing an embodiment of the laminated tip seal wherein "V"-shaped notches are provided on the edge of the tip seal adjacent the bottom of the groove.
Figure 6:
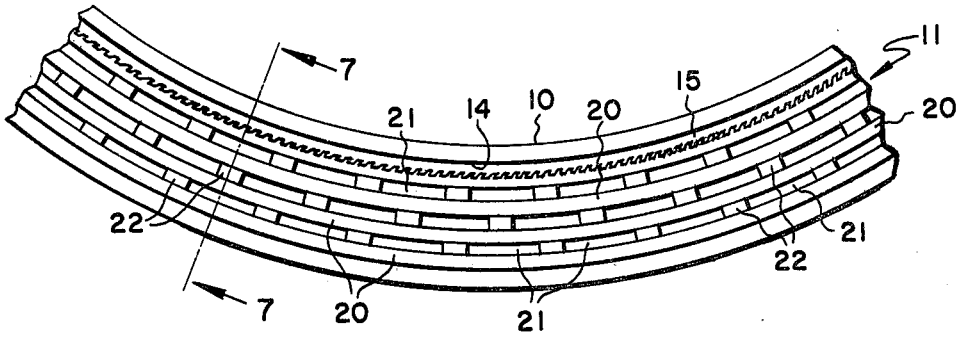
FIG. 6 is an exploded plan view of the exposed edge of another embodiment of the involute and tip seal, wherein the notches in the strips are transversely misaligned.
Figure 7:
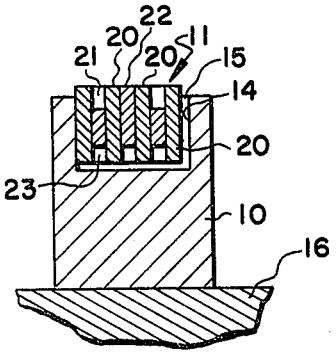
FIG. 7 is a cross-sectional view of the involute and tip seal taken along section line 7—7 of FIG. 6.
Figure 5A:
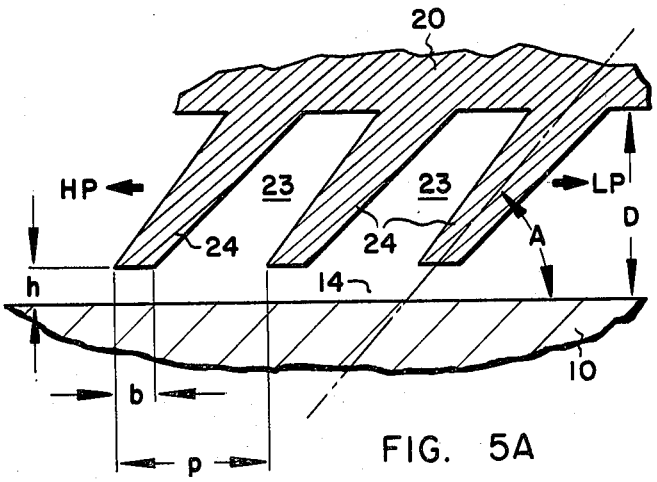
FIG. 5A is an exploded view of part of FIG. 5 showing the dimensional relationship of the "V"-shaped notches.

The width of strips 21 (in the axial direction) is slightly greater than the depth of groove 14, so that tip seal 11 extends beyond the tip surface of involute 10. Tip seal 11 may be axially biased to insure adequate sealing contact by means of helical coil springs 25 seated within bores 26 of involute 10 disposed at intervals along its longitudinal length, as shown in FIGS. 4 and 5. Other spring biasing means for effecting an axial force on a laminated tip seal are disclosed in U.S. patent application No. 232,526, filed on Feb. 9, 1981 and assigned to the same assignee as the present application. Alternatively, tip seal 11 may be biased in both an axial and radial direction by a differential pressure developed as pockets of fluid are compressed between involutes 10. This differential pressure is applied to tip seal 11 through gap 15, which provides a passage for compressed fluid to flow between the tip seal and the interior surface of groove 14. The concept of using the pneumatic pressure differential across an involute to effect both radial and axial sealing of a tip seal (single piece) is disclosed in detail in U.S. Pat. No. 3,994,636.

Due to their relatively thin cross-section, material strips 20 are flexible in bending about the axis 17 and thus easily conform to the spiral shape of the involute groove 14. In contrast, they are relatively rigid with respect to flexure in the axial direction. Due to their thin cross-section, the labyrinth surface comprising rectangular notches 21 and "V"-shaped notches 23 may be formed in strips 20 very easily, for example, either by a machining process, or by stamping the strips from a metallic or non-metallic sheet material using a die which includes the appropriate notched pattern. As shown in the drawings, strips 20 are assembled in alternating relationship, notched and unnotched, in side-by-side relationship to form the labyrinth surface. If manufactured from a metallic material, strips 20 may be spot welded at spaced-apart locations along their longitudinal length, as indicated by reference numeral 27, or may be attached together at one or both ends by welding or by other suitable means. Strips 20 may also be seated into groove 14 without providing any means to secure adjacent strips to each other at any point along their length. In this case, they are merely fitted into groove 14 starting at one end thereof, and held in place by their own spring tension and by their friction against the internal walls of groove 14 until involute 10 is assembled in a scroll machine.

The labyrinth surface provided by "V"-shaped notches 23 tends to break up the flow of gaseous fluid along the bottom of groove 14 by causing pressure drops due to continuous accelerations and expansions of that fluid. This substantially reduces the longitudinal leakage rate of the compressed fluid along the bottom of groove 14. It will be apparent that an additional leakage path in the longitudinal direction is provided by the gap 15 between the tip seal 11 and the side of groove 14. Leakage along gap 15 may be substantially reduced by knurling the outer surface of strip 21 which is adjacent gap 15 or by machine scribing it to form a plurality of grooves 28 extending across its lateral surface in an axial direction. The grooves 28 in this strip 21 reduce fluid leakage longitudinally along gap 15 in much the same manner that "V"-shaped notches control fluid leakage along the bottom of groove 14.

In the embodiments shown in FIGS. 2, 3, 4, and 5, rectangular notches 21 are generally aligned in the radial direction along the longitudinal length of tip seal 11. In the embodiment illustrated in FIGS. 6 and 7, rectangular-shaped notches 21 comprising the labyrinth surface of tip seal 11 are radially misaligned, and may be disposed in a relatively random pattern.

It should be explained that the rectangular-shaped notches 21 used on the outwardly facing labyrinth surface of tip seal 11 are not as effective for sealing in the longitudinal direction as the "V"-shaped notches 23 used on the surface adjacent the bottom of groove 14. However, notches 21 must provide both longitudinal and radial sealing capability, and the outwardly facing surface of tip seal 11 must be capable of effecting this seal while in sliding contact with the facing end plate 16 of the other scroll. Rectangular notches 21 thus are believed to provide a compromise design for a labyrinth type tip seal with a significant improvement in sealing efficiency compared to a single piece tip seal or a laminated tip seal which is not provided with a labyrinth surface.

In the preferred embodiments of the subject invention shown in the Figures, tip seal 11 comprises seven materials strips 20, four of which do not include notches 21 or 23, and three of which do. Depending upon the thickness of strips 20, and the radial width of groove 14, a different number of strips 20 may be used for tip seal 11. Furthermore, it is not necessary that notches 21 and 23 be formed along the edges of the same strip 20, since the notches might equally well be formed along opposite edges of adjacent strips. Although it is not essential that the rectangular-shaped notches 21 or the "V"-shaped notches 23 be formed in every other strip 20, it is generally true that the greater the frequency with which such notches occur, the more efficient will be the resulting fluid seal.

Numerous other alternatives to those thus far disclosed will be apparent to persons skilled in the art. For example, if the gap 15 is within the range 0.001 to 0.002 inches, axially aligned grooves 28 should not be required. Furthermore, although steel is a preferred material, strips 21 may be formed from a plastic material such as nylon. Tip seal 11 may also comprise a combination of metallic and non-metallic strips 20. In some applications, it may not be necessary to use both rectangular notches 21 or "V"-shaped notches 23 on tip seal 11.

While the subject invention has been described with respect to the preferred embodiments, it is to be understood that further modifications thereto such as those described above would be apparent to those skilled in the art, which modifications lie within the scope of the present invention as defined in the claims which follow.

I claim:

1. For use in a positive fluid displacement apparatus of the scroll type, a tip seal comprising a plurality of material strips, generally coaligned in side-by-side parallal relationship along a common spiral path about an axis, one or more of said strips including a plurality of notches along at least one edge thereof, which in conjunction with one or more other of the strips and an axially adjacent flat surface against which said edge may abut, define a plurality of labyrinth pockets longitudinally spaced apart along the strips.

2. For use in a positive fluid displacement apparatus of the scroll type, a tip seal comprising three or more material strips, generally coaligned in side-by-side parallel relationship along a common spiral path about an axis, a longitudinal edge of one or more of said strips including a plurality of notches, said one or more notched strips disposed between other of the strips so that their adjacent sides and a surface against which the longitudinal edges of the strips may abut define a plurality of labyrinth pockets longitudinally spaced apart along the strips, said pockets reducing both transverse and longitudinal fluid leakage past the tip seal.

3. The tip seal of claims 1 or 2 wherein the notches in one of the strips are transversely aligned with respective notches in another strip.

4. The tip seal of claim 1 or 2 wherein the notches in one of the strips are transversely misaligned with the respective notches in another strip.

5. The tip seal of claims 1 or 2 further comprising means for joining the strips together.

6. The tip seal of claim 5 wherein the strips are metallic and said means for joining the strips comprise spot welding.

7. The tip seal of claims 1 or 2 wherein the strips are thinner in the transverse direction from side-to-side than they are wide from edge-to-edge, both measured at right angles to the longitudinal axis.

8. The tip seal of claim 7 wherein the notches are rectangular in shape, being longer in length measured parallel to the longitudinal axis than in depth measured across the width of the strip.

9. The tip seal of claims 1 or 2 wherein the notches are generally an angled "V" shape, with a longer side and a shorter side, the open part of the "V" being along the edge of the strip, and the longer side of the "V" being disposed longitudinally closer to the end of the strip which is subjected to a higher operating fluid pressure than the other end of the strip.

10. The tip seal of claims 1 or 2 wherein the plurality of strips include on or more strips with notches along one edge and one or more strips with notches along the opposite edge, said edges being opposite in the axial direction relative to the coaligned parallel relationship of the strips.

11. The tip seal of claim 10 wherein both edges of one or more of the strips include notches.

12. The tip seal of claims 1 or 2 wherein at least one of the strips on its lateral side includes a plurality of aligned grooves spaced longitudinally along the strip, said strip being disposed as the outermost of the strips comprising the tip seal, with the grooves defining a plurality of pockets in conjunction with an adjacent spiral surface.

13. For use in a positive fluid displacement apparatus of the scroll type, an involute and tip seal comprising a. a wrap element of generally spiral configuration about an axis, said wrap element including a radially inner and a radially outer flank surface terminating in a tip;

b. a groove formed in the tip and running in the longitudinal direction of the wrap element, substantially conforming to its spiral shape;

c. a plurality of material strips, generally coaligned in parallel side-by-side relationship and disposed within the spiral groove at the tip of the wrap element, one or more of said strips including a plurality of notches along at least one edge thereof, which in conjunction with one or more other of the strips and a flat surface against which said edge abuts, define a plurality of labyrinth pockets longitudinally spaced along the strips.

14. For use in a positive fluid displacement apparatus of the scroll type, an involute and tip seal comprising a. a wrap element generally configured in a spiral about an axis, said wrap element being substantially quadrilateral in cross-section, and including radially inner and outer flank surfaces extending in an axial direction and terminating in a tip which lies in a plane substantially perpendicular to said axis;

b. a groove formed in the tip and generally conforming to its spiral shape in the longitudinal direction of the wrap element, said groove having at least one side wall on its radially outer side which is substantially parallel to the axis;

c. three or more strips, generally coaligned in side-by-side parallel relationship, and disposed at least partially within said groove in conformance to its spiral path, with the sides of said strips parallel to said axis, and with the side of the radially outermost strip operatively in sealing contact with said one side wall of the groove, an edge of one or more of said strips including a plurality of notches, said one or more notched strips disposed between other of the strips so that their adjacent sides and an axially adjacent surface against which the edges of the strips abut define a plurality of labyrinth pockets longitudinally spaced apart along the strips, thereby reducing both transverse and longitudinal fluid leakage past the tip seal.

15. The involute and tip seal of claim 13 or 14 wherein the notches in one of the strips are transversely aligned with respective notches in another strip.

16. The involute and tip seal of claim 13 or 14 wherein the notches in one of the strips are transversely misaligned with the respective notches in another strip.

17. The involute and tip seal of claim 13 or 14 further comprising means for joining the strips together.

18. The involute and tip seal of claim 17 wherein the strips are metallic and said means for joining the strips comprise spot welding.

19. The involute and tip seal of claim 13 or 14 wherein the strips are thinner in the transverse direction from side-to-side than they are wide from edge-to-edge, both measured at right angles to the longitudinal axis.

20. The involute and tip seal of claim 19 wherein the notches are rectangular in shape, being longer in length, measured longitudinally along the strip, than in depth, measured across the width of the strip.

21. The involute and tip seal of claim 13 or 14 wherein the notches are generally an angled "V" shape, with a longer side and a shorter side, the open part of the "V" being along the edge of the strip, and the longer side of the "V" being disposed longitudinally closer to the end of the strip which is subjected to a higher operating pressure than the other end of the strip.

22. The involute and tip seal of claim 13 or 14 wherein both edges of one or more of the strips include notches.

23. The involute and tip seal of claim 13 or 14 wherein a radial side of at least one of the strips includes a plurality of axially aligned grooves spaced longitudinally along the strip, said grooves and strip being disposed adjacent a radial wall of said involute groove and in conjunction therewith, defining a plurality of pockets.

24. The involute and tip seal of claim 13 or 14 wherein the plurality of strips include one or more strips with notches along one edge and one or more strips with notches along the opposite edge, said edges being opposite in the axial direction relative to the coaligned parallel relationship of the strips.

25. The involute and tip seal of claim 13 or 14 further comprising means for biasing the strips away from the bottom of the groove in an axial direction.

26. The involute and tip seal of claim 25 where the biasing means is a resilient material having springlike properties.

27. The involute and tip seal of claim 25 where the biasing means is fluid pressure.

* * * * *